United States Patent [19]

Leshem

[11] 4,011,794

[45] Mar. 15, 1977

[54] MAGAZINE-LOADING DEVICE FOR GRENADE LAUNCHERS

[76] Inventor: Matatjahu Leshem, 79 Shderot Hanassi, Haifa, Israel, 34642

[22] Filed: Apr. 25, 1974

[21] Appl. No.: 464,276

[52] U.S. Cl. ..... 89/47; 89/45

[51] Int. Cl.[2] ..... F41F 9/06

[58] Field of Search ..... 89/1 F, 1 J, 1.801, 89/1.802, 33 A, 33 B, 34, 37 C, 45, 47

[56] References Cited

UNITED STATES PATENTS

| | | | |
|---|---|---|---|
| 37,364 | 1/1863 | Stevens | 89/47 |
| 2,427,035 | 9/1947 | Wilcoxon | 89/1 J |
| 2,922,338 | 1/1960 | Barbe | 89/1 F |
| 3,343,456 | 9/1967 | Christiansson | 89/33 B |
| 3,507,184 | 4/1970 | Prybyla | 89/33 B |
| 3,927,598 | 12/1975 | Eriksson | 89/45 |

*Primary Examiner*—Stephen C. Bentley
*Attorney, Agent, or Firm*—John C. Smith, Jr.

[57] ABSTRACT

The magazine-loading device is designed for loading fin-stabilized projectiles or shells into the barrels of grenade launchers. The magazine-loading device comprises a shell storage enclosure having an inclined elongated base designed for supporting a series of fin-stabilized shells in side-by-side relationship. A shell-receiving unit is located at the lower end of the base and is arranged to receive the lowermost shell of the series which is transferred by displacement means from the shell-receiving unit into the barrel of an adjacent grenade launcher. Releasable retaining means is arranged to retain the shells in position above the shell-receiving unit while a shell is being transferred and to release the shells allowing them to move downwardly with the lowermost shell entering the shell-receiving unit after the shell previously in the shell-receiving unit has been transferred to the grenade launcher barrel.

8 Claims, 4 Drawing Figures

FIG. 1
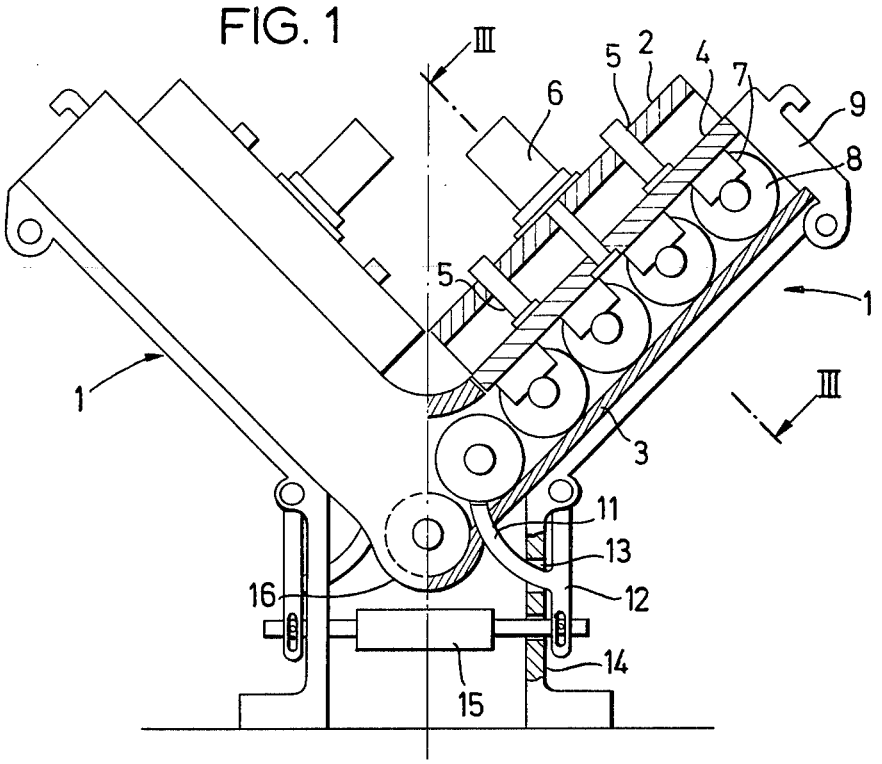
FIG. 3
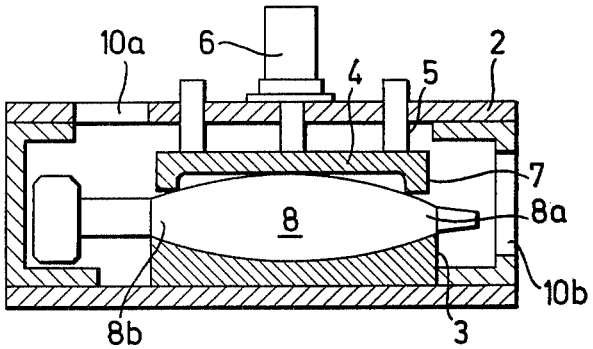
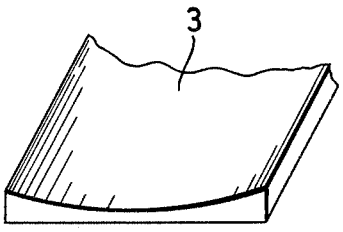
FIG. 4

MAGAZINE-LOADING DEVICE FOR GRENADE LAUNCHERS

This invention relates to a magazine and loading device for use with grenade launchers. The magazine and loading device is primarily designed for loading fin-stabilized projectiles or shells into the barrel of a grenade launcher. The grenade launcher itself may have a conventional single-part barrel or a two-part barrel as disclosed for example in British Pat. No. 868,271 wherein during the loading operation the lower, high-pressure tube part of the barrel is lowered from firing position into a substantially horizontal position for loading.

In recent years the caliber of grenade launchers has steadily increased, and consequently the size and weight of the fin-stabilized shells used with such launchers have reached such proportions that the manual loading of the launchers has become extremely difficult, if not impossible. Even where the barrel can be displaced to a horizontal position for loading, the manual loading operation is difficult and time-consuming. Furthermore, present-day combat conditions generally require the grenade launcher to be readily transportable, and consequently the launcher is frequently mounted on an appropriately armored vehicle. Manual loading of such vehicle-mounted grenade launchers requires the loading personnel to be unnecessarily exposed to danger or necessitates the construction of cumbersome protective installations on the vehicle.

Furthermore, the conventional loading of grenade launchers unnecessarily limits the firing rate. A grenade launcher mounted on a vehicle usually remains in any given firing location for only a limited period of time, and the number of shots that can be fired by a grenade launcher at a particular firing location is necessarily limited because of the time required for manual loading.

Various devices have been developed for mechanically loading grenade launchers. (See for example my Israel Pat. Nos. 17082, 2445, and 31064). Such devices are designed to mechanically load the grenade launcher while the barrel is maintained in firing position, and consequently the loading devices provide means for raising the shells to a position where they can be loaded into the grenade launcher barrel. It will be appreciated that with the increasing weight of the shells the mechanism required for transporting and raising the shells into loading position must necessarily be substantial.

It is an object of the present invention to provide an improved magazine and loading device for grenade launchers.

A further object of the present invention is to provide an improved magazine and loading device which is arranged to load shells into the barrel of a grenade launcher while the barrel is in a substantially horizontal position.

A still further object of the present invention is to provide an improved magazine and loading device which will load shells into the barrel of a grenade launcher at a faster rate than was previously possible, thus increasing the firing rate of the grenade launcher.

Briefly, the magazine and loading device of the present invention comprises at least one shell storage enclosure which is inclined upwardly with respect to the horizontal for containing a plurality of fin-stabilized shells arranged in series and in side-by-side relationship. At the lower end of the shell storage enclosure, a shell-receiving unit is provided which is arranged to receive the lowermost shell of the series. This shell-receiving unit is arranged horizontally such that when the barrel of a grenade launcher is lowered to a substantially horizontal position the end of the barrel is aligned with one end of the shell-receiving unit. To load the grenade launcher, displacement means is provided at the opposite end of the shell-receiving unit for transferring a shell contained therein into the barrel of the grenade launcher. Releasable retaining means is provided for retaining the series of shells in the shell storage enclosure above the shell-receiving unit and for releasing these shells allowing them to progress downwardly as the lowermost shell in the shell-receiving unit is transferred to the barrel of a grenade launcher during the loading operation.

For a more detailed understanding of the present invention, reference is made to the following description of a preferred embodiment of the magazine and loading device and the accompanying drawings in which:

FIG. 1 is an end elevation partially in section of the magazine-loading device;

FIG. 3 is a cross-sectional view of the device shown in FIG. 1 taken along the line III—III; and FIG. 4 is a perspective view of a portion of the shell-receiving base shown in FIGS. 1 and 3.

Figure 2:
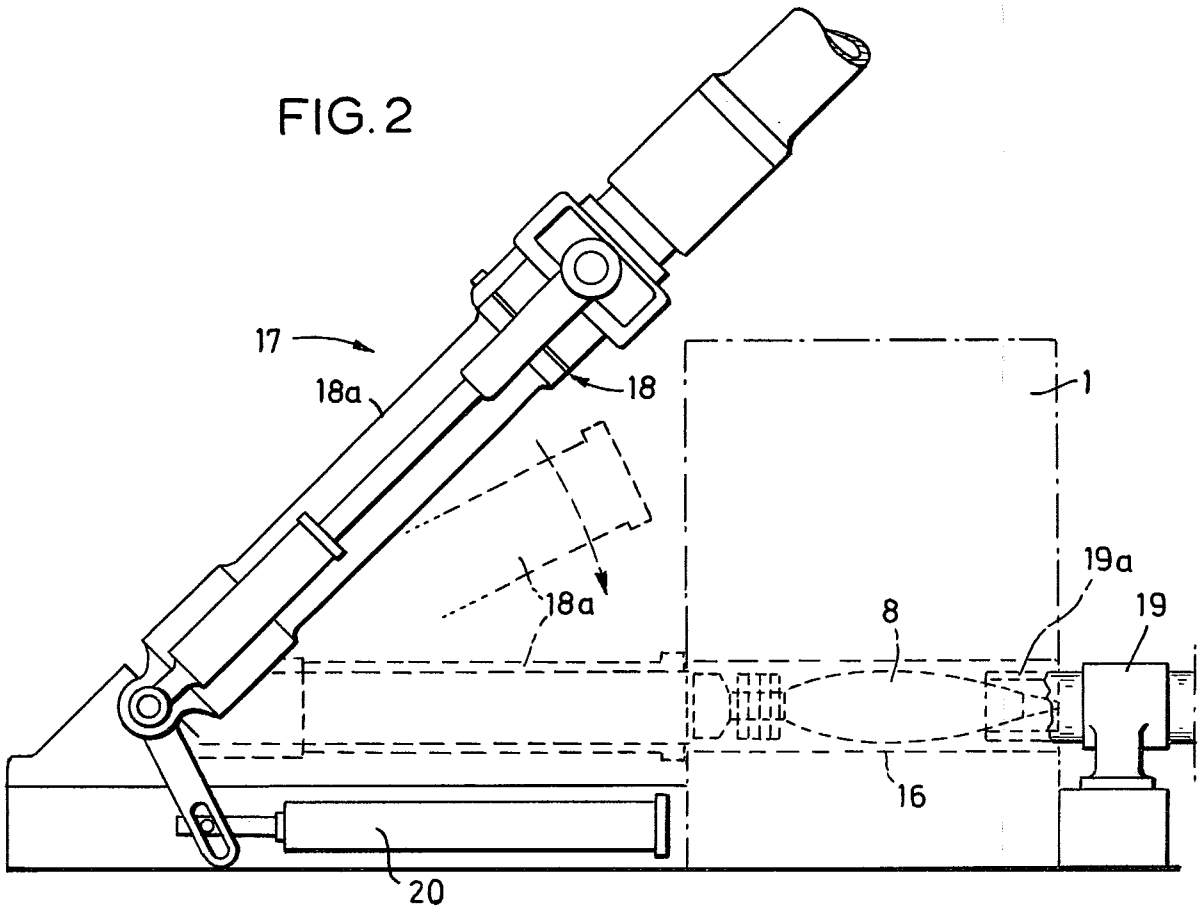
FIG. 2 is a side elevation of the device associated with a two-part barrel grenade launcher.

Referring to the drawings, a pair of box-like shell storage enclosures 1 are respectively inclined upwardly with respect to the horizontal. Preferably, the two enclosures are arranged at a right angle to each other.

Each of the enclosures comprises a substantially fixed, box-like frame 2 which includes on the lower side thereof a shell-receiving base 3. The shell-receiving base 3 is formed with an oval recessed receiving surface, as illustrated in FIGS. 3 and 4, so that a shell 8 located thereon can be moved only in a direction transverse to its axis and, in view of the inclination of the base 3, in a downward direction. Also located within the enclosure is a displaceable upper wall 4 which is coupled, via coupling rods 5, to a hydraulic or pneumatic displacing means 6 mounted on the box-like frame 2. The displaceable wall 4 is formed with a plurality of successive pairs of retaining fingers 7, each pair of fingers 7 being adapted to engage a shell 8 respectively adjacent the ogival **8*a* and tail 8*b* portions thereof (FIG. 3). Each enclosure 1 is provided with a hinged closure 9 which may be opened to insert the shells 8 into the enclosure. The hinged closure 9** is normally retained in a closed position by means not shown.

As is clearly illustrated in FIG. 3, each enclosure 1 and frame 2 is so constructed as to provide for apertures **10*a* and 10*b* in the region of the fuse and tail portions of shell 8 to permit the positioning or removal of the shell fuse and booster when the shell 8 is located in the enclosure 1**.

At least one curved retaining arm 11 (only one arm 11 is shown in FIG. 1) extends from a hinged mounting bar 12 through an appropriate aperture 13 formed in a mounting frame 14 and another aperture formed in the receiving base 3 so as to project into the enclosure 1. In this position, the curved retaining arm 11 supports the lowermost shell 8 contained in the enclosure 1 preventing its downward movement. The mounting bar 14 is pivoted by displacement means 15 to withdraw the curved retaining arm 11 when the lowermost shell 8 is to be moved downwardly.

Located below the pair of enclosures 1 and communicating therewith is a shell-receiving unit 16 which comprises a U-shaped trough formed integrally with and constituting a lower extension of the receiving bases 3 in the two enclosures 1. It will be appreciated that the enclosures 1 are of identical construction, one constituting the mirror image of the other but having the shell-receiving unit 16 common to both enclosures.

As illustrated in FIG. 2, the magazine-loading device is associated with a grenade launcher 17 which in this instance has a two-part barrel 18, details of which are described in British Pat. No. 868,271. The lower, high-pressure tube part 18*a* of the barrel is arranged to be lowered into a substantially horizontal position as shown in dotted lines. In this position, the lower part of the barrel is aligned with the elongated shell-receiving unit 16 of the magazine-loading device, also shown in dotted lines in the drawings. Shell-displacing means 19 having a hollow receiving cup 19*a* in which the shell fuse can fit without being contacted serves, upon actuation, to displace the shell 8, transferring the shell from the shell-receiving unit 16 into the lower part 18*a* of the barrel 18. The lower part of the barrel 18*a* is then returned to its normal firing position, movement of the lower part of the barrel being controlled by displacing means 20.

To load the magazine-loading device itself, curved retaining arm 11 is located in its retaining position, i.e. projecting into the enclosure 1, the displaceable wall 4 is in a raised position, enclosure member 9 is pivoted into an open position, and shells 8 are then loaded into the enclosure 1. When fully loaded, the wall 4 is lowered into position with the retaining fingers 7 gripping the respective shells which are thereby prevented from moving either axially or transversely, and the closure 9 is pivoted to the closed position.

A complete cycle in the operation of the magazine-loading device in cooperation with a grenade launcher will now be described:

1. The grenade launcher is fired.
2. The lower part 18*a* of the barrel 18 is lowered from its firing position to a substantially horizontal position in which it is aligned with the receiving unit 16.
3. A shell 18 in the receiving unit 16 is transferred into the lower barrel part 18*a* by shell displacing means 19.
4. The lower barrel part 18*a* is raised into firing alignment with the upper barrel part.
5. The retaining arm(s) 11 is pivoted in a counter-clockwise direction by displacing means 15, thereby allowing the lowermost shell 18 in the enclosure 1 to fall into the shell-receiving unit 16.
6. The retaining arm(s) 11 is pivoted in a clockwise direction into its retaining position.
7. The upper wall is raised by displacing means 6 raising the retaining fingers 7 and allowing the retained shells 8 to slide downwardly to a point where the lowermost shell in the enclosure 1 is retained by retaining arm(s) 11.
8. The upper wall 4 with the retaining fingers 7 is moved downwardly by displacing means 6 so as to retain the newly positioned shells above the lowermost shell which is retained separately by retaining arm(s) 11.

It will be appreciated that the above steps may be fully synchronized by the actuation of four displacing mechanisms, namely:

1. The retaining finger displacing mechanism 6,
2. The retaining arm displacing mechanism 15,
3. The shell displacing mechanism 19, and
4. The lower barrel part displacing mechanism 20.

Furthermore, with the pair of enclosures shown in the drawings a predetermined sequence involving displacement of the two sets of retaining arms and retaining finger mechanisms 6 and 15 can be arranged so as to ensure that shells from the two enclosures drop alternately from each enclosure into the receiving unit 16.

It will be appreciated that, while in the specific embodiment illustrated a two-enclosure device is described, this number is not critical; and a single-enclosure device would be equally suitable.

The various displacing mechanisms can be electrically, mechanically, hydraulically or pneumatically operated; and appropriate servo-mechanisms can be used to ensure the full automation of shell displacement and loading.

With the magazine-loading device of the present invention, the movement of the shells from the shell storage enclosure into the shell receiving unit takes place under the influence of gravity, while the transfer of the shells from the receiving unit into the barrel involves displacement in a substantially horizontal direction. It will be evident therefore that only minimal amounts of energy are required, both to ensure displacement of shells and to ensure the retention of the shells in the storage enclosure.

Furthermore, the loading of the shells in the upwardly inclined shell storage enclosure can take place between firing rounds under relatively protected conditions. In addition, the maximum height to which the shells must be raised for loading in the upward inclined shell storage enclosure is substantially less than the height to which they would be required to be raised to be loaded into the barrel of a grenade launcher while the latter is retained in its firing position.

The foregoing embodiment of the invention is intended to be merely exemplary, and those skilled in the art will be able to make many variations and modifications of the embodiment without departing from the spirit and scope of the invention. All such modifications and variations are intended to be within the scope of the invention as defined in the appended claims.

I claim:

1. A magazine-loading device for loading grenade launchers with shells comprising, in combination:

a. an elongated shell storage enclosure which is upwardly inclined with respect to the horizontal, for receiving a series of shells in side-by-side relationship and transversely directed with respect to the longitudinal axis of said enclosure, the enclosure including an ovally recessed surface for contacting the corresponding side surfaces of said shells and means for inhibiting movement of said shells in the transverse direction;

b. releasable shell retaining means associated with the enclosure for releasably retaining each of the shells in the enclosure against downward displacement under gravity;

c. a shell receiving unit located substantially horizontally at the lower end of the enclosure for receiving the lowermost shell located in the enclosure when said retaining means retaining said lowermost shell is released; and d. shell displacing means associated with said shell receiving unit for displacing a shell located in the unit into the barrel of a grenade launcher.

2. A device according to claim 1 further comprising actuating means responsively coupled to said retaining and displacing means for actuating and deactuating said retaining and displacing means in a predetermined sequence.

3. The device according to claim 1 wherein said releasable retaining means comprises separate first and second releasable retaining means, said first releasable retaining means being arranged to retain the shell of said series adjacent said shell receiving unit and to release said shell permitting said shell to be displaced downwardly into said shell receiving unit, and said second retaining means being adapted to retain the remainder of said series of shells above said shell adjacent said shell receiving unit while said first retaining means releases said shell which enters said shell receiving unit and to release said remaining shells after said first retaining means is again positioned to retain the next lowermost shell of said remainder of said series of shells.

4. A device according to claim 3 wherein said first retaining means comprises at least one pivotally mounted retaining arm for supporting a shell at its underside and means for pivotally displacing said arm between a shell retaining position and a shell releasing position.

5. The device according to claim 3 wherein said second retaining means comprises a plurality of pairs of retaining elements, each of said pairs being arranged to engage a shell at two spaced positions, and means for displacing said pairs of retaining elements between a position wherein said pairs of elements engage and retain said shells and a position releasing said shells permitting their downward movement along said elongated base towards said shell receiving unit.

6. The device according to claim 1 wherein said shell receiving unit comprises an elongated trough, said displacement means for displacing a shell from said shell receiving unit into the barrel of said launcher being positioned at one end of said trough.

7. A device according to claim 1 comprising a plurality of said elongated bases each inclined upwardly from said one shell receiving unit for feeding shells into said one shell receiving unit, one of said means for releasably retaining the shells being associated with each said elongated bases.

8. In combination, a grenade launcher and a magazine-loading device according to claim 1, said launcher including a barrel and means for displacing said barrel between a firing position and a loading position adjacent said shell receiving unit of said magazine-loading device such that said displacing means can transfer a shell from said shell receiving unit to said barrel.

* * * * *